US005966007A

United States Patent [19]

Okada et al.

[11] Patent Number: 5,966,007

[45] Date of Patent: Oct. 12, 1999

[54] CURRENT SOURCE CIRCUIT

[75] Inventors: Hiroshi Okada, Fujisawa; Naoki Itoh, Kawasaki, both of Japan

[73] Assignee: Kabushiki Kaisha Toshiba, Kawasaki, Japan

[21] Appl. No.: 09/114,240

[22] Filed: Jul. 13, 1998

[30] Foreign Application Priority Data

Jul. 14, 1997 [JP] Japan ..... 9-188725
Jun. 10, 1998 [JP] Japan ..... 10-162153

[51] Int. Cl.[6] ..... G05F 3/16

[52] U.S. Cl. ..... 323/315

[58] Field of Search ..... 323/312, 315; 330/257, 288; 327/535, 538

[56] References Cited

U.S. PATENT DOCUMENTS

| | | | |
|---|---|---|---|
| 4,525,683 | 6/1985 | Jason | 330/288 |
| 5,266,852 | 11/1993 | Shigenari et al. | 330/257 |
| 5,451,859 | 9/1995 | Ryat | 323/312 |
| 5,483,151 | 1/1996 | Yamashita | 323/315 |
| 5,637,993 | 6/1997 | Whitney et al. | 323/315 |
| 5,684,393 | 11/1997 | Ryat | 323/312 |
| 5,757,232 | 5/1998 | Hosoya | 330/252 |

FOREIGN PATENT DOCUMENTS

| | | |
|---|---|---|
| 0 299 723 | 1/1989 | European Pat. Off. . |
| WO 82/01105 | 4/1982 | WIPO . |

*Primary Examiner*—Matthew Nguyen
*Attorney, Agent, or Firm*—Oblon, Spivak, McClelland, Maier & Neustadt, P.C.

[57] ABSTRACT

A current source circuit has a current mirror circuit and a correct ion circuit. The current mirror circuit includes first to fourth transistors. The bases of the first and second transistors are commonly connected to each other. A collector of the third transistor is connected to a common base of the first and second transistors. An emitter of the third transistor is connected to an emitter of the fourth transistor. A base of the fourth transistor is connected to the collector of the first transistor. The correction circuit includes fifth to eighth transistors. The base of the fifth and sixth transistors are commonly connected to each other. An emitter of the seventh transistor is connected to the common base of the fifth and sixth transistors. A collector of the seventh transistor is connected to an emitter of the eighth transistor. A base of the eighth transistor is connected to the collector of the second transistor.

10 Claims, 6 Drawing Sheets

CURRENT SOURCE CIRCUIT

BACKGROUND OF THE INVENTION

The present invention relates to a semiconductor integrated circuit using bipolar transistors and, more particularly, a current source circuit which is improved in respect of the variation in the input/output current ratio due to the dispersions of elements and the change in ambient temperature.

FIG. 1 shows the constitutional arrangement of a conventional synchronous detection circuit as an example of a semiconductor integrated circuit provided with a current source circuit.

In this synchronous detection circuit, an input signal VIN superimposed on a DC bias voltage VB is supplied to the base of an NPN transistor Q1. Further, two pairs of NPN transistors Q2, Q3 and Q4, Q5 arranged in such a manner that the emitters of the transistors in the respective pairs are connected to each other are controlled in synchronism with switch control signals SW1, SW2 supplied to the bases of the respective transistors, whereby, from the common collectors of the transistors Q3, Q5, a detection output signal OUT is derived.

In this case, used as a load to the transistors Q2, Q3, Q4 and Q5 is a current mirror circuit (current source circuit) 10 comprised of PNP transistors Q6, Q7, Q8 and Q9, an NPN transistor Q10, and resistors R1, R2 and R3.

In this current mirror circuit 10, the emitter of the transistor Q6 is connected to a voltage node 11 through the resistor R1. A positive DC bias voltage VA is supplied to the node 11. The collector of the transistor Q6 is connected to a current input terminal 12. Also connected to this current input terminal 12 are the respective collectors of the transistor Q2, Q4. The emitter of the transistor Q7 is connected to the voltage node 11 through the resistor R2. The base of the transistor Q7 is connected commonly to the base of the transistor Q6, and the collector thereof is connected to a current output terminal 13. Also connected to this current output terminal 13 are the respective collectors of the transistors Q3, Q5. The emitter of the transistor Q9 is connected to the voltage node 11 through the resistor R3. The base and collector of the transistor Q9 are connected to the common bases of the transistors Q6 and Q7. The transistor Q9 and the resistor R3 are provided for preventing the current mirror circuit 10 from oscillating.

The collector of the transistor Q10 is connected to the common base of the transistors Q6 and Q7. The emitter of the transistor Q10 is connected to the emitter of the transistor Q8. The base of the transistor Q8 is connected to the collector of the transistor Q6, while the collector of the transistor Q8 is connected to a voltage node 14 which is supplied with the earth voltage.

Further, the circuit consisting of NPN transistors Q11, Q12, Q13 and Q14, resistors R4 and R5, and constant-current sources I1, I2, I3 and I4 feeds the common emitter of the transistors Q2, Q3 and the common emitter of the transistors Q4, Q5 with a current corresponding to the input signal VIN or a current corresponding to the constant voltage generated by a constant-voltage generation circuit to be described later, the circuit being constituted as follows:

That is, the bases of the transistors Q11, Q12 are connected to the emitter of the transistor Q1. The collector of the transistor Q11 is connected to a node N1 which is supplied with the constant voltage, while the emitter thereof is connected through the constant-current source 11 to the voltage node 14 placed at the earth voltage. The collector of the transistor Q12 is connected to the common emitter of the transistors Q2, Q3, while the emitter thereof is connected to the voltage node 14 through the constant-current source I2. The bases of the transistors Q13, Q14 are connected to the node N1. The collector of the transistor Q13 is connected to the common emitter of the transistors Q4, Q5, while the emitter thereof is connected to the voltage node 14 through the constant-current source I3. The collector of the transistor Q14 is connected to the emitter of the transistor Q1, while the emitter thereof is connected to the voltage node 14 through the constant-current source I4.

Further, between the emitters of the transistors Q12, Q13, the resistor R4 is connected, while between the emitters of the transistors Q11, Q14, the resistor R5 is connected.

The circuit consisting of PNP transistors Q15, Q16, Q17, NPN transistors Q18, Q19, and a resistor R6 constitutes a constant-voltage generation circuit. That is, the emitter of the transistor Q15 is connected to the voltage node 11 through the resistor R6. The emitter of the transistor Q16 is connected to the voltage node 11, while the base thereof is connected to the base of the transistor Q15. Further, the base and collector of the transistor Q16 are short-circuited to each other. The collector and base of the transistor Q18 are connected to the collector of the transistor Q15. Further, a common connection node N2 between the collector and base of the transistor Q18 is connected to the base of the transistor Q10. The emitter of the transistor Q17 is connected to the emitter of the transistor Q18.

The collector of the transistor Q19 is connected to the collector of the transistor Q16. Further, the bases of the transistors Q17, Q19 are commonly connected to each other, and, to these commonly connected bases, a DC bias voltage VB is supplied. The collector of the transistor Q17 is connected to the voltage node 14, and the emitter of the transistor Q19 is connected to the node N1.

By the way, in a current mirror circuit in general, there is provided means for correcting the error in the input/output current ratio which is caused by the base currents of transistors etc.; and, in the case of the current mirror circuit 10 shown in FIG. 1, the transistors Q8 and Q10 are provided for correcting the error in the input/output current ratio due to the base current of the transistors Q6, Q7 and the base-collector current of the transistor Q9, and further, a current of a value corresponding to the currents which cause the error is made to flow to the earth voltage node through the transistor Q8.

However, the base current itself of the correcting transistor Q8 joins to the collector current of the transistor Q6; and thus, the base current causes an error in the input/output current ratio of the current mirror circuit.

Due to this, in the circuit shown in FIG. 1, a correction circuit 20 is further provided to correct the error due to the base current of the transistor Q8.

This correction circuit 20 is comprised of PNP transistors Q20, Q21, and a resistor R7. That is, the emitter of the transistor Q20 is connected to the voltage node 11 through the resistor R7, while the base thereof is connected to the common base of the transistors Q6, Q7 in the current mirror circuit 10. The emitter of the transistor Q21 is connected to the collector of the transistor Q20, the base thereof is connected to the collector of the transistor Q7 in the current mirror circuit 10, and the collector thereof is connected to the voltage node 14.

In the correction circuit 20, the transistor Q20 constitutes a current mirror together with the transistor Q6 in the current mirror circuit 10. Further, by setting the value of the resistor R7 so that the base currents of the transistors Q8 and Q21 may become equal to each other, the sum of the collector current of the transistor Q6 and the base current of the transistor Q8 and the sum of the collector current of the transistor Q7 and the base current of the transistor Q21 are equalized to each other. By so doing, the error in the input/output current ratio caused by the base current of the transistor Q8 is corrected.

By the way, in the conventional circuit shown in FIG. 1, the value of the base current of the transistor Q8 becomes 1/hfe (wherein hfe stands for the current amplification factor) times as large as the total sum of the base current of the transistor Q6, the base current of the transistor Q7, the base current and collector current of the transistor Q9, and the base current of the transistor Q20. The correction for the base current of the transistor Q8 is made by only the base current (which is 1/hfe times as large as the collector current of the transistor Q20) of the transistor Q21.

Due to this, even if the value of the base current of the transistor Q21 is set or adjusted under a certain condition, an unbalance is caused between the base currents of the transistors Q8 and Q21 in some cases due to the dispersions of the elements and the variation in ambient temperature. As a result, there arises the problem that the values of the currents which flow to the node 13 at which the detection output signal OUT is derived and to the node N3 which is paired with the node 13 and is the common collector node of the transistors Q2, Q4 are varied due to the dispersions of the elements and the variation in the ambient temperature, as a result of which the input/output current ratio comes to vary.

Further, so far, the potential at the node N3 paired with the node at which the detection output signal OUT is derived is determined by the VB+VBE (Q17)+VBE (Q18)−VBE (Q10)−VBE (Q8), wherein VBE (Qi) (i=1, 2 . . . ) stands for the base-emitter voltages of the respective transistors. However, the potential at the node at which the detection output signal OUT is obtained is not determined unconditionally, becoming indeterminate. Due to this, there has also been caused the problem that the values of the emitter-collector voltages VCE of the transistors Q6 and Q7 become different from each other; and, by the influence of the early effect, the collector currents of the transistors Q6 and Q7 become unbalanced.

BRIEF SUMMARY OF THE INVENTION

Thus, it is the object of the present invention to provide a current source circuit constituted in such a manner that the input/output current ratio of the current mirror circuit can always be maintained constant without being affected by the dispersions of the elements and the variation in the ambient temperature.

Another object of the present invention is to provide a current source circuit constituted in such a manner that the occurrence of an unbalance between the collector currents by the influence of the early effect based on the difference between the emitter-collector voltages of a pair of transistors constituting a current mirror circuit can be prevented.

According to an embodiment of the present invention there is provided a current source circuit comprising: a first voltage node to which a first voltage is supplied; a second voltage node to which a second voltage lower than the first voltage is supplied; a current mirror circuit including a first transistor of a first polarity which has a base, an emitter and a collector, the emitter being coupled to the first voltage node, a second transistor of the first polarity which has a base, an emitter and a collector, the emitter being coupled to the first voltage node, the base being connected commonly to the base of the first transistor, a third transistor of a second polarity opposite to the first polarity, the third transistor having a base, an emitter and a collector, the collector being connected to a base common connection node of the first and second transistor, and a fourth transistor of the first polarity which has a base, an emitter and a collector, the emitter being connected to the emitter of the third transistor, the base being connected to the collector of the first transistor, the collector of the fourth transistor being connected to the second voltage node, wherein the collectors of the first and second transistors are used as current input and output terminals of the current mirror circuit; and a correction circuit including a fifth transistor of the first polarity which has a base, an emitter and a collector, the emitter being coupled to the first voltage node, a sixth transistor of the first polarity which has a base, an emitter and a collector, the emitter being coupled to the first voltage node, the base being connected commonly to the base of the fifth transistor, the collector being connected to the base of the third transistor, a seventh transistor of the first polarity which has a base, an emitter and a collector, the emitter being coupled to a base common connection node of the fifth and sixth transistors, the base being connected to the collector of the fifth transistor, an eighth transistor of the first polarity which has a base, an emitter and a collector, the emitter being connected to the collector of the seventh transistor, the base being connected to the collector of the second transistor, the collector of the eighth transistor being connected to the second voltage node, and a ninth transistor of the second polarity which has a base, an emitter and a collector, the base and the collector being connected to the base of the third transistor, the emitter being connected to the emitter of the eighth transistor.

According to another embodiment of the present invention, there is provided a current source circuit comprising: a first voltage node to which a first voltage is supplied; a second voltage node to which a second voltage lower than the first voltage is supplied; a current mirror circuit including a first transistor of a first polarity which has a base, an emitter and a collector, the emitter being coupled to the first voltage node, a second transistor of the first polarity which has a base, an emitter and a collector, the emitter being coupled to the first voltage node, the base being connected commonly to the base of the first transistor, a third transistor of the first polarity which has a base, an emitter, a collector, the emitter being connected to a base common connection node of the first and second transistors, the base being connected to the collector of the first transistor, the collector of the third transistor being connected to the second voltage node, and a fourth transistor of the first polarity which has a base, an emitter and a collector, the emitter being coupled to the first voltage node, the base and the collector being connected to the base common connection node of the first and second transistors, wherein the collectors of the first and second transistors are used as current input and output terminals of the current mirror circuit; and a correction circuit including a fifth transistor of the first polarity which has a base, an emitter and a collector, the emitter being coupled to the first voltage node, a sixth transistor of the first polarity which has a base, an emitter and a collector, the emitter being coupled to the first voltage node, the base being connected commonly to the base of the fifth transistor, the collector being connected to the second voltage node, a seventh transistor of the first polarity which has a base, an emitter and a collector, the emitter being coupled to the first voltage note, the base being connected to a base common connection node of the fifth and sixth transistors, an eighth transistor of the first polarity which has a base, an emitter and a collector, the emitter being connected to a base common connection node of the fifth, sixth and seventh transistors, the base being connected to the collector of the fifth transistor, the collector of the eighth transistor being connected to the collector of the seventh transistor, and a ninth transistor of a second polarity which has a base, an emitter and a collector, the emitter being connected to the collector of the eighth transistor, the base being connected to the collector of the second transistor, the collector of the ninth transistor being connected to the second voltage node.

According to still another embodiment of the present invention, there is provided a current source circuit comprising: a first voltage node to which a first voltage is supplied; a second voltage node to which a second voltage lower than the first voltage is supplied; a current mirror circuit including a first transistor of a first polarity which has a base, an emitter and a collector, the emitter being coupled to the first voltage node, a second transistor of the first polarity which has a base, an emitter and a collector, the emitter being coupled to the first voltage node, the base being connected commonly to the base of the first transistor, a third transistor of a second polarity opposite to the first polarity, the third transistor having a base, an emitter and a collector, the collector being connected to a base common connection node of the first and second transistors, a fourth transistor of the first polarity which has a base, an emitter and a collector, the emitter being connected to the emitter of the third transistor, the base being connected to the collector of the first transistor, the collector of the fourth transistor being connected to the second voltage node, and a fifth transistor of the first polarity which has a base, an emitter and a collector, the emitter being coupled to the first voltage node, the base and the collector being connected to the base common connection node of the first and second transistors, wherein the collectors of the first and second transistors are used as current input and output terminals of the current mirror circuit; and a correction circuit including a sixth transistor of the first polarity which has a base, an emitter and a collector, the emitter being coupled to the first voltage node, a seventh transistor of the first polarity which has a base, an emitter and a collector, the emitter being coupled to the first voltage node, the base being connected commonly to the base of the sixth transistor, the collector being connected to the second voltage node, an eighth transistor of the first polarity which has a base, an emitter and a collector, the emitter being coupled to the first voltage node, the base being connected to a base common connection node of the sixth and seventh transistors, the collector being connected to the base of the third transistor, a ninth transistor of the first polarity which has a base, an emitter and a collector, the emitter being connected to a base common connection node of the sixth, seventh and eighth transistors, the base being connected to the collector of the sixth transistor, a tenth transistor of the first polarity which has a base, an emitter and a collector, the emitter being connected to the collector of the ninth transistor, the base being connected to the collector of the second transistor, the collector of the tenth transistor being connected to the second voltage node, and an eleventh transistor of the second polarity which has a base, an emitter and a collector, the base and the collector being connected to the base of the third transistor, the emitter being connected to the emitter of the tenth transistor.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described by reference to the drawings.

Figure 1:
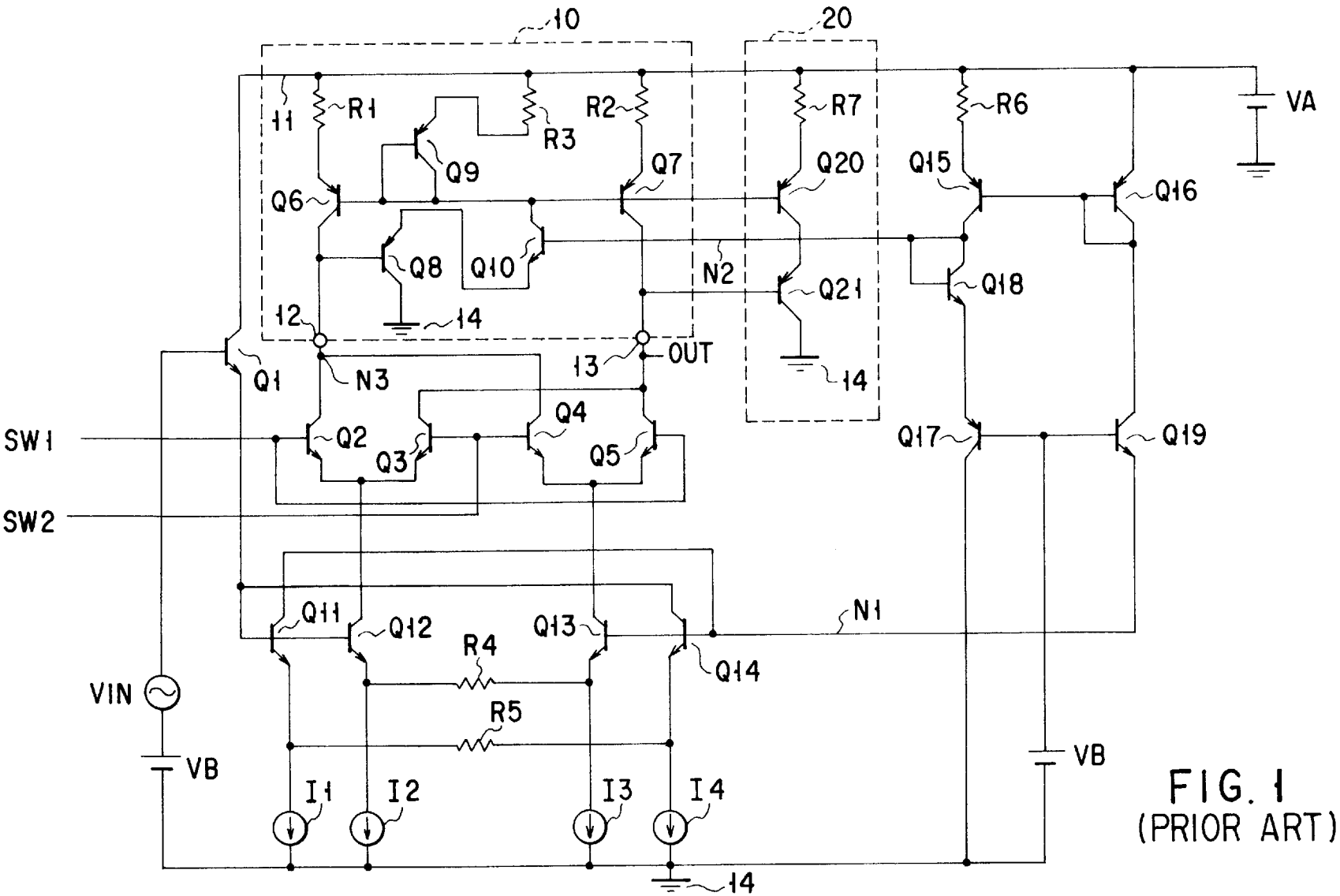
FIG. 1 (PRIOR ART)
FIG. 1 is a circuit diagram of a conventional synchronous detection circuit.
Figure 2:
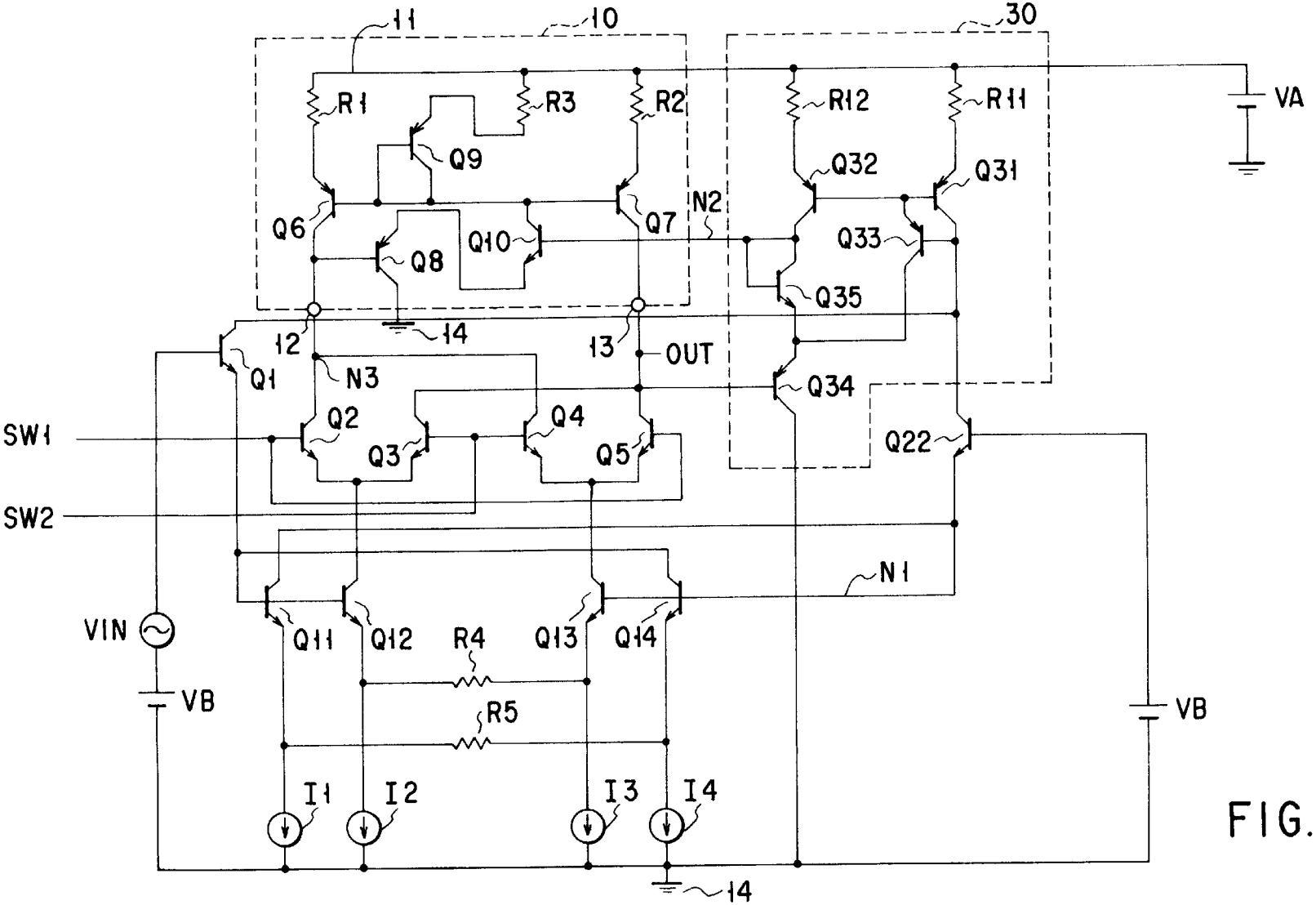
FIG. 2 is a circuit diagram of the synchronous detection circuit according to a first embodiment of the present invention.

FIG. 2 is a circuit diagram of the semiconductor integrated circuit according to a first embodiment of the present invention; as the semiconductor integrated circuit, a synchronous detection circuit is exemplarily shown as in the case of the conventional semiconductor integrated circuit. In the description to follow, the constitutent portions which correspond to those in the conventional circuit shown in FIG. 1 are referenced by the same reference numerals.

Supplied to the base of an NPN transistor Q1 is an input signal VIN superimposed on a DC bias voltage VB. In the case of the conventional circuit shown in FIG. 1, the collector of this transistor Q1 is connected to the voltage node 11 to which the DC bias voltage VA is supplied, but in this embodiment, the collector of the transistor Q1 is connected to a predetermined node in a collection circuit to be described later.

The emitters of each of two pairs of NPN transistors Q2, Q3 and Q4, Q5 are connected commonly to each other, and, to the bases of the transistors Q2 and Q5, a switch control signal SW1 is supplied, while to the bases of the transistors Q3, Q4, a switch control signal SW2 is supplied. The collectors of the transistors Q2, Q4 are commonly connected to each other, and the collectors of the transistors Q3, Q5 are connected commonly to each other. Further, from a common connection node of the collectors of the transistors Q3, Q5, a detection output signal OUT is derived.

Used as a load to the transistors Q2, Q3, Q4 and Q5 is a current mirror circuit 10 which is comprised of PNP transistors Q6, Q7, Q8 and Q9, an NPN transistor Q10 and resistors R1, R2 and R3.

In the current mirror circuit 10, the emitter of the transistor Q6 is connected through the resistor R1 to the voltage node 11 to which a positive DC bias voltage VA is supplied. The collector of the transistor Q6 is connected to a current input terminal 12. Connected to this current input terminal 12 is the common collector of the transistors Q2, Q4. The emitter of the transistor Q7 is connected to the voltage node 11 through the resistor R2. The base of the transistor Q7 is connected commonly to the base of the transistor Q6, while the collector thereof is connected to a current output terminal 13. Connected to this current output terminal 13 is the common collector of the transistors Q3, Q5. The emitter of the transistor Q9 is connected to the voltage node 11 through the resistor R3. The base and collector of the transistor Q9 are connected to the common base of the transistors Q6, Q7.

The transistor Q9 and the resistor R3 are provided for preventing the current mirror circuit from oscillating.

In the case of the synchronous detection circuit according to this embodiment, a new correction circuit 30 is provided in place of the conventional correction circuit 20. This correction circuit 30 comprises PNP transistors Q31, Q32, Q33 and Q34, an NPN transistor Q35, and resistors R11, R12.

This correction circuit 30 corrects the base current of the transistor Q8 in the current mirror 10 and, at the same time, corrects the unbalanced state of the collector currents, based on the early effect, of the transistors Q6 and Q7

The PNP transistors Q31 and Q32 correspond to the transistors Q6 and Q7 in the current mirror circuit 10; and the bases of the transistors Q31 and Q32 are connected commonly to each other as in the case of the transistors Q6, Q7. Further, the resistors R11 and R12 correspond to the resistors R1, R2 in the current mirror circuit 10, and, through the resistors R11, R12, the transistor Q31, Q32 are connected to the voltage node 11 to which the DC bias voltage VA is supplied.

The emitter of the transistor Q33 is connected to the common base of the transistors Q31, Q32, while the base thereof is connected to the collector of the transistor Q31. Further, the emitter of the transistor Q34 is connected to the collector of the transistor Q33, while the base thereof is connected the collector of the transistor Q7 in the current mirror circuit 10, while the collector thereof is connected to the voltage node 14 placed at the earth voltage.

The collector and base of the transistor Q35 are connected to the collector of the transistor Q32 and also to a node N2 to which the base of the transistor Q10 in the current mirror circuit 10. The emitter of the transistor Q35 is connected to the emitter of the transistor Q34. The collector of the transistor Q34 is connected to the node 14.

Further, in the circuit according to this embodiment, in order to apply a constant voltage to the above-mentioned node N1, there is provided an NPN type transistor Q22. That is, the collector of the transistor Q22 is connected to the collector of the above-mentioned transistor Q1 and also to the collector of the transistor Q31, the emitter thereof is connected to the node N1, and the base thereof is supplied with a DC bias voltage VB.

The current ratio of the constant-current sources I1, I2, I3 and I4 are set to 1:2:2:1.

In this synchronous detection circuit, the transistors Q31 to Q35 and the resistors R11 and R12 are provided in the correction circuit 30 to thereby constitute within the correction circuit 30 a current mirror equal to the current mirror comprising the transistors Q6, Q7, Q10, Q8 and the resistors R1, R2 in the current mirror circuit 10, and further, the transistor Q35 is provided in such a manner that the base-emitter current path thereof is inserted between the emitter of the transistor Q34 and the base of the transistor Q10 in the current mirror circuit 10.

Further, in order to generate a constant voltage to be supplied to the node N1, the transistor Q22 corresponding to the transistor Q1 is added.

Further, in the current mirror circuit 10, the resistors R1 to R3 can be omitted, but in case they are omitted, the resistors R11 and R12 in the correction circuit 30 can be omitted.

As for the circuit shown in FIG. 2, in the current mirror circuit 10, the base current of the transistor QS flows into the collector of the transistor Q6 from the common base of the transistors Q6, Q7 through the collector-emitter current path of the transistor Q10 and through the emitter-base current path of the transistor Q8.

On the other hand, in the correction circuit 30, the base current of the transistor Q34 flows into the collector of the transistor Q7 from the common base of the transistors Q31, Q32 through the emitter-collector current path of the transistor Q33 and through the emitter-base current path of the transistor Q34.

Due to this, various conditions such as the element sizes of the transistors Q6 and Q31, the transistors Q7 and Q32, the transistors Q10 and Q35, and the transistors Q8 and the Q34, and the resistance values of the resistors R1 and R11, and the resistors R2 and R12 are made equal to each other, whereby the base current of the transistor Q8 can be set to approximately the same value of the base current of the transistor Q34.

Here, it is to be noted that, in case dispersions are caused among the elements when manufactured, the dispersions of the elements which are equal in respect of the various conditions become equal to one another, so that the values of the two base currents vary equally in accordance with the dispersions of the elements. Further, in case the ambient temperature is taken into consideration, it is pointed out that, since the circuit arrangement of the portion of the correction circuit 30 in which the base current of the transistor Q34 is produced is approximately equal to that in the current mirror circuit 10, the variations of the two base currents due to the variation in ambient temperature becomes equal to each other. As a result, the input/output current ratio of the current mirror circuit can be maintained constant without being influenced by the dispersions of the elements and the variation in emboldened temperature.

On the other hand, the voltage at a node N3 (the current input terminal 12 of the current mirror circuit 10) which is a common collector node of the transistors Q2, Q4 assumes the value determined in such a manner that the voltage at the node (the current output terminal 13 of the current mirror circuit 10) at which the detection output signal OUT is derived is raised by a value corresponding to the respective base-emitter voltages VBE of the transistors Q34, Q35, and the resulting voltage value is lowered by a value corresponding to the respective base-emitter voltages VBE of the transistors Q10, Q8. Here, generally it can safely be considered that the respective VBE of a PNP transistor and that of an NPN transistor are equal to each other, so that the voltage at the node N3 turns out to be equal to the voltage at the node at which the detection output signal OUT is derived. As a result, the emitter-collector voltages VCE of the transistors Q6 and Q7 can be equalized to each other; and thus, the problem that, by the influence of the early effect caused by the fact that the values of the respective emitter-collector voltages VCE differ from each other, the collector currents of the transistor Q6 and Q7 become unbalanced can be overcome.

Further, the voltage at the node N1 becomes a constant voltage having the value lower by the base-emitter voltage of the transistor Q22 than the DC bias voltage VB.

Figure 3:
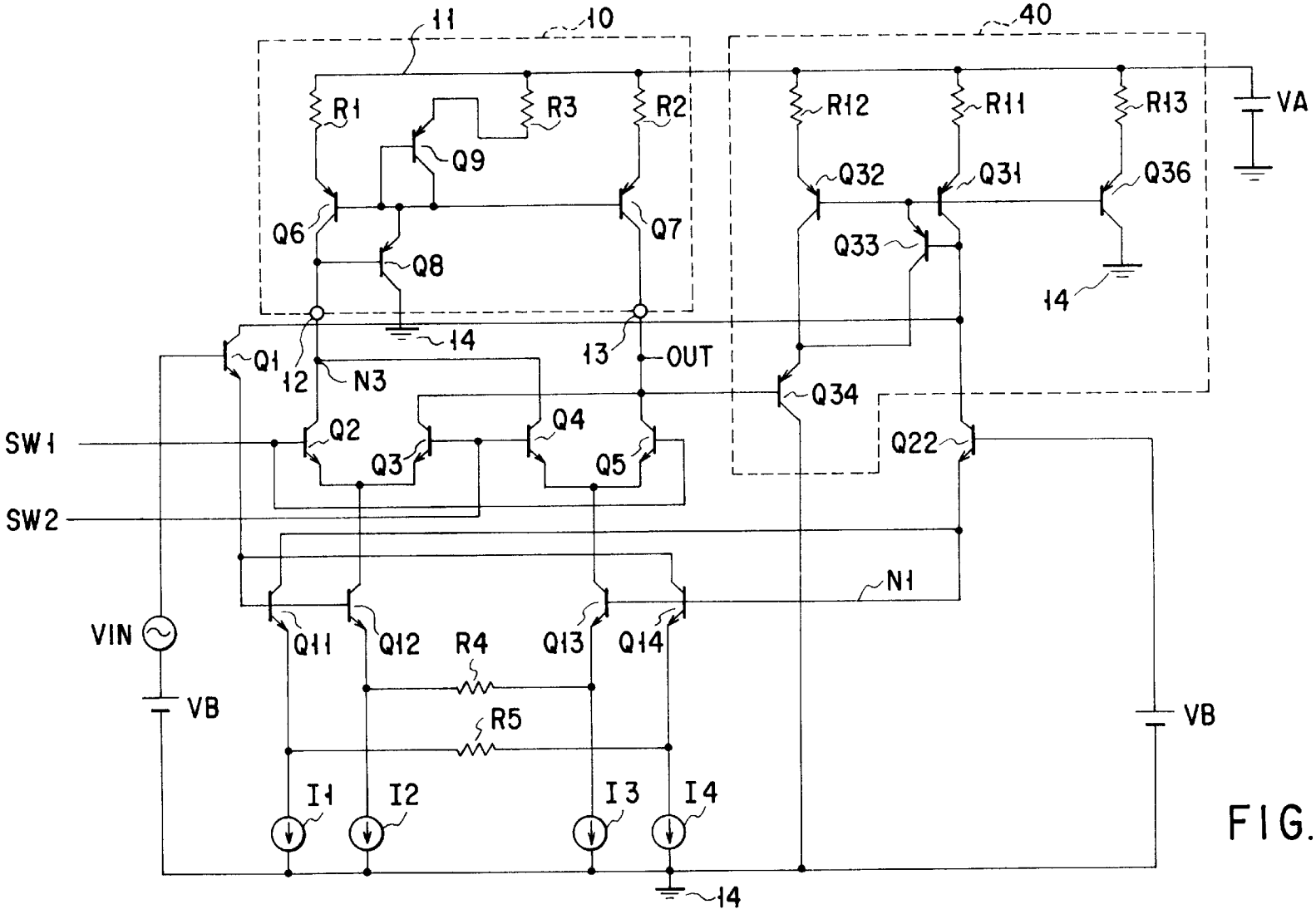
FIG. 3 is a circuit diagram of the synchronous detection circuit according to a second embodiment of the present invention.

FIG. 3 shows the constitutional arrangement of the semiconductor integrated circuit according to a second embodiment of the present invention. In this circuit shown in FIG. 3, the constitutent portions which correspond to those of the circuit according to the first embodiment shown in FIG. 2 are referenced by the same reference symbols.

The synchronous detection circuit according to this second embodiment differs from the synchronous detection circuit shown in FIG. 2 in that the transistor Q10 in the current mirror 10 is omitted, that the emitter of the base current correction transistor QB is directly connected to the common base of the transistors Q6 and Q7, and that, in place of the correction circuit 30 shown in FIG. 2, a different correction circuit 40 is provided.

The correction circuit 40 differs form the correction circuit 30 shown in FIG. 2 in that the transistor Q35 is omitted in association with the fact that the transistor Q10 in the current mirror circuit 10 is omitted, and that a PNP transistor Q36 and a resistor R13 are newly added. Due to the omission of the transistor Q35, the collector of the transistor Q32 is connected to the emitter of the transistor Q34.

Further, the emitter of the newly added transistor Q36 is connected through the resistor R13 to the voltage node 11 to which the DC bias voltage VA is supplied. Further, the base of this transistor Q36 is connected to the base common connection node of the transistors Q31, Q32, and the collector thereof is connected to the voltage node 14 to which the earth voltage is supplied.

Further, in the case of this second embodiment, the resistors R1 to R3 may be omitted in the current mirror circuit 10, but, in case the resistors are omitted, the resistors R11 to R13 can be likewise omitted on the side of the correction circuit 40.

With such a constitutional arrangement, in the current mirror circuit 10, the base current of the transistor Q8 flows into the collector of the transistor Q6 from the common base of the transistors Q6 and Q7 through the emitter-base current path of the transistor Q8.

On the other hand, in the correction circuit 40, the base current of the transistor Q34 flows into the collector of the transistor Q7 from the common base of the transistors Q31, Q32 and Q36 through the emitter-base current path of the transistor Q33 and the emitter-base current path of the transistor Q34.

Here, it is to be noted that the base current of the transistor Q8 in the current mirror circuit 10 turns out to be 1/hfe of the total sum of the base current of the transistor Q6, the base current and the collector current of the transistor Q9, and the base current of the transistor Q7, that is, 1/hfe of the total sum of the base currents of three transistors and the collector current of one transistor; and thus, the base current of the transistor Q8 can be represented as (Ic+3Ib)/hfe wherein Ib stands for a base current, and Ic stands for a collector current.

On the other hand, in the correction circuit 40, the collector current of the transistor Q33 becomes 3Ib−α which is slightly smaller than the total sum of the base currents of the three transistors Q31, Q32 and Q36. To the collector of the transistor Q34, the collector current of the transistor Q33 and the collector current of the transistor Q32 join together, so that, if it is assumed that Ic stands for the collector current of the transistor Q32, then the collector current of the transistor Q34 is represented as (Ic+3Ib−α), and the base current of the transistor Q34 is represented as (Ic+3Ib−α)/hfe. Here, the α/hfe is sufficiently small as compared with (Ic+3Ib−α)/hfe, so that the base current of the transistor Q8 and the base current of the transistor Q34 can safely be regarded as approximately equal to each other.

Here, it is to be noted that, in case dispersions are caused among the elements when manufactured, the dispersions of the elements which are equal in respect of the various conditions become equal, so that the values of the two base currents vary equally in accordance with the dispersions of the elements. Further, in case the ambient temperature is taken into consideration, it is pointed out that the circuit arrangement of the portion of the correction circuit 40 in which the base current of the transistor Q34 is generated is approximately equal to that of the current mirror circuit 10, so that the variations of the two base currents due to the variation in ambient temperature also become equal.

As a result, in the case of the embodiment shown in FIG. 3, it is also possible to maintain the input/output current ratio of the current mirror circuit constant without being affected by the dispersions of the elements and the variation in the ambient temperature.

Next, a third embodiment of the present invention will be described, referring to FIG. 4.

The synchronous detection circuit according to this embodiment differs from the synchronous detection circuit shown in FIG. 3 in that, in place of the correction circuit 40 shown in FIG. 3, a different correction circuit 50 is provided. The correction circuit 50 differs from the correction circuit 40 shown in FIG. 3 in that an NPN transistor Q37 and a constant-current source I5 are newly added.

The collector of the newly added transistor Q37 is connected to the voltage node 11 to which the DC bias voltage VA is supplied, and the base thereof is connected to the collector of the transistor Q32. Further, the emitter of the transistor Q37 is connected through the constant-current source I5 to the voltage node 14 to which the earth voltage is applied.

As shown, to the collector of the transistor Q31 in the correction circuit 50, the base currents of the transistors Q11 to Q14 and the collector currents of the transistors Q11 and Q14 flow through the transistor Q1 or Q22. That is, the collector current of the transistor Q31 is increased by an amount corresponding to the currents flowing through these transistors Q11 to Q14. In response to this, the collector current of the transistor Q32 is also increased, as a result of which a discrepancy is caused between the base current of the transistor Q8 in the current mirror circuit 10 and the base current of the transistor Q34 in the correction circuit in some cases.

In the correction circuit 50 according to this embodiment, the increased amount of the collector current of the transistor Q32 due to the currents flowing through the transistors Q11 to Q14 can be made to flow as the base current to the transistor Q37, so that the discrepancy between the base current of the transistor Q8 in the current mirror circuit 10 and the base current of the transistor Q34 in the correction circuit 50 can be sufficiently reduced, whereby the input/output current ratio in the current mirror circuit 10 can be maintained constant.

The constant-current source I5 should be formed by the use of transistors having uniform characteristics as well as the above-mentioned constant-current sources I1 to I4.

Next, a fourth embodiment of the present invention will be described by reference to FIG. 5.

In the synchronous detection circuit according to this embodiment, in place of the correction circuit 30 according to the first embodiment shown in FIG,. 2, a different correction circuit 60 is provided.

The correction circuit 60 differs from the correction circuit 30 shown in FIG. 2 in that the correction circuit 60 is constituted in such a manner that the transistor Q36 and the resistor R13 in the correction circuit 40 shown in FIG. 3 are added into the correction circuit 30 shown in FIG. 2.

Therefore, according to this fourth embodiment, the correction of the base current component of the transistor Q8 can be made, by the correction circuit 60, in association with the collector current and the base current of the oscillation preventing transistor Q9 in the current mirror circuit 10 as in the case of the embodiment shown in FIG. 3; and thus, the current correction can be effected at a higher accuracy.

Figure 6:
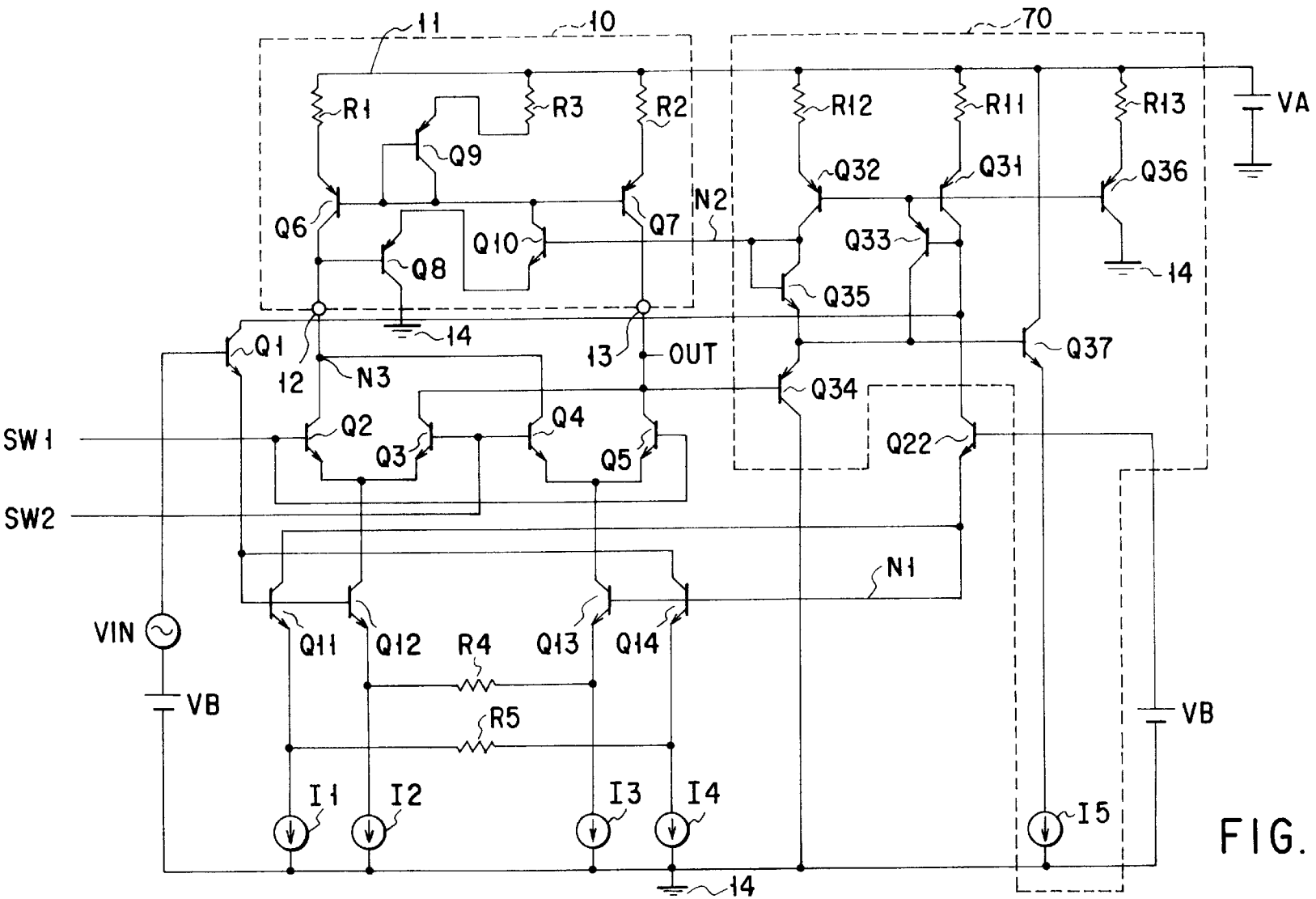
FIG. 6 is a circuit diagram of the synchronous detection circuit according to a fifth embodiment of the present invention.

Next, a fifth embodiment of the present invention will be described by reference to FIG. 6.

Figure 5:
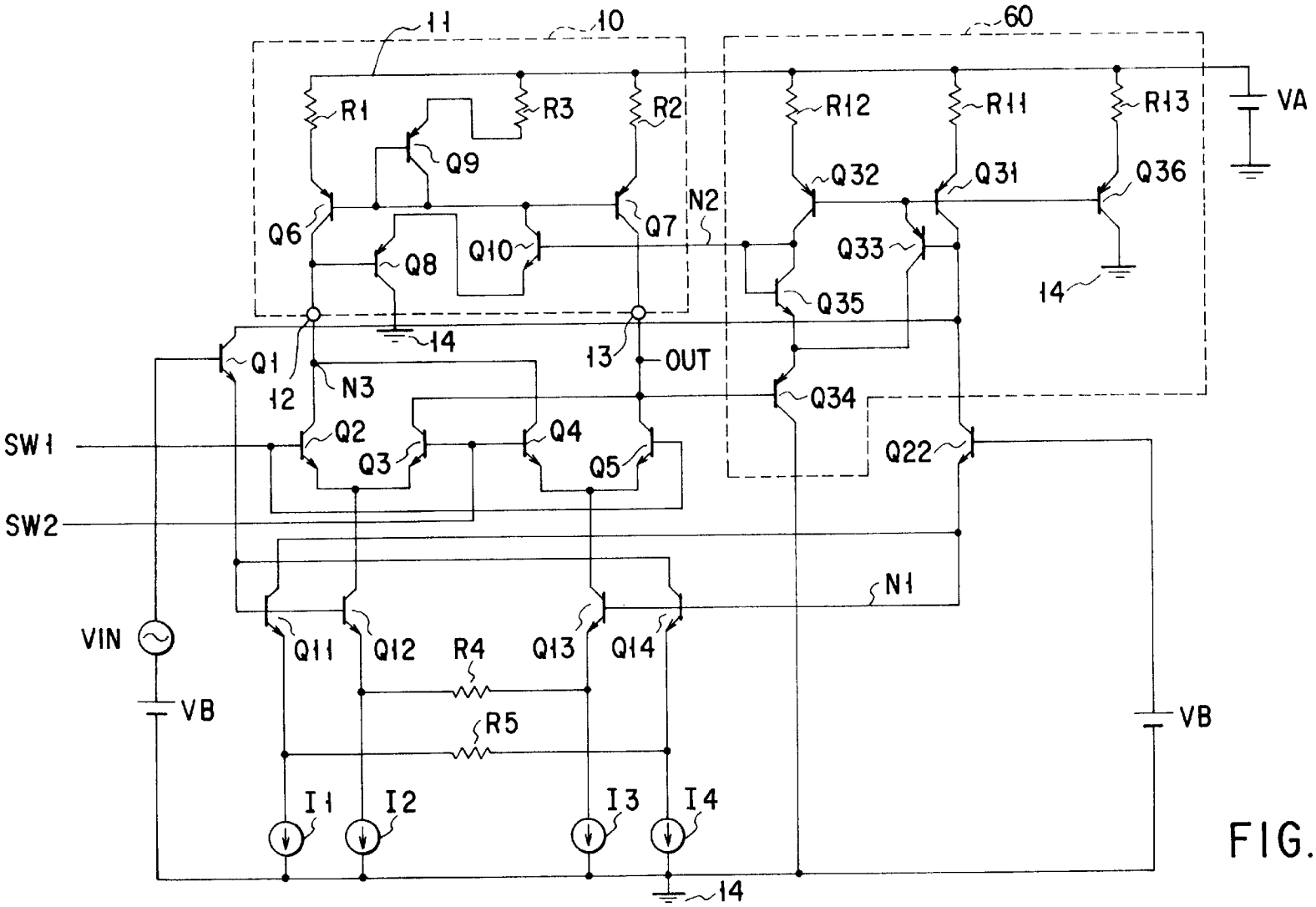
FIG. 5 is a circuit diagram of the synchronous detection circuit according to a fourth embodiment of the present invention.

In the synchronous detection circuit according to this embodiment, in place of the correction circuit 60 according to the fourth embodiment shown in FIG. 5, a different correction circuit 70 is provided.

Figure 4:
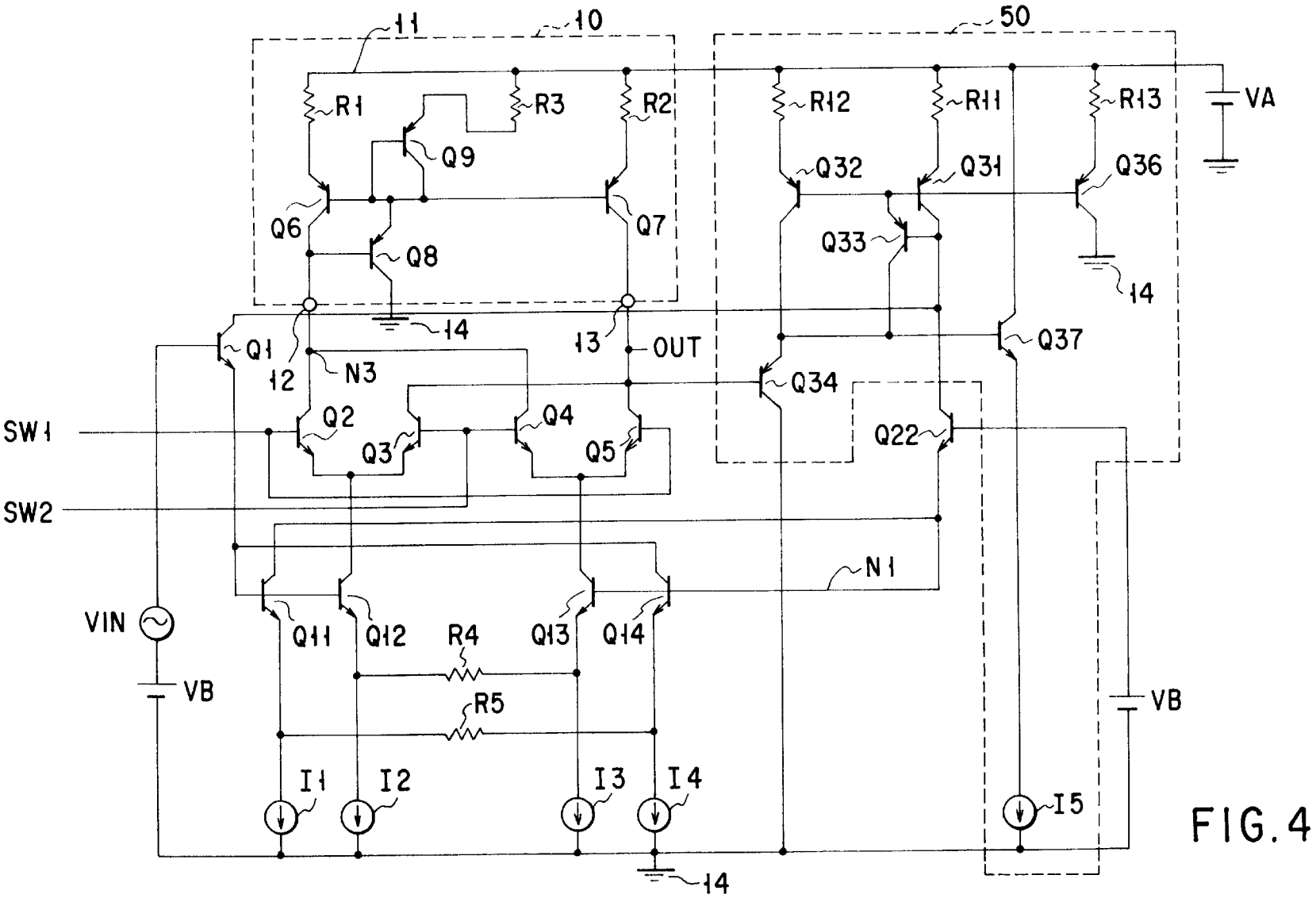
FIG. 4 is a circuit diagram of the synchronous detection circuit according to a second embodiment of the present invention.

The correction circuit 70 differs from the correction circuit 60 shown in FIG. 5 in that, into the correction circuit 60 shown in FIG. 5, the transistor Q37 and constant-current source I5 in the correction circuit 50 shown in FIG. 4 are added.

Therefore, according to this embodiment, there can be obtained the effect that, on the basis of the currents flowing through the transistors Q11 to Q14, the discrepancy caused between the base current of the transistor Q8 in the current mirror circuit 10 and the base current of the transistor Q34 in the correction circuit 70 can be sufficiently reduced, whereby the input/output current ratio in the current mirror circuit 10 can be made constant.

It is a matter of course that the present invention is not limited only to the above-described embodiments but can be variously modified. For instance, in the respective embodiments mentioned above, the present invention is applied to synchronous detection circuits, but the current source circuit according to the present invention can be easily applied in circuits directed to any other use.

As described above, according to the present invention, there can be provided a current source circuit constituted in such a manner that the input/output current ratio of a current mirror circuit can be maintained constant without being affected by the dispersions of the elements and the variation in ambient temperature.

Further, according to the present invention, the occurrence of an unbalanced state of the collector currents by the influence of the early effect based on the difference between the emitter-collector voltages of the transistors constituting the current mirror circuit can also be prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

We claim:

1. A current source circuit comprising:

a first voltage node to which a first voltage is supplied;

a second voltage node to which a second voltage lower than said first voltage is supplied;

a current mirror circuit including a first transistor of a first polarity having a base, an emitter and a collector, said emitter of said first transistor being coupled to said first voltage node, a second transistor of the first polarity having a base, an emitter and a collector, said emitter of said second transistor being coupled to said first voltage node, said base of said second transistor being connected commonly to the base of said first transistor, a third transistor of a second polarity opposite to the first polarity having a base, an emitter and a collector, said collector of said third transistor being connected to a base common connection node of said first and second transistor, and a fourth transistor of the first polarity having a base, an emitter and a collector, said emitter of the fourth transistor being connected to the emitter of said third transistor, said base of said fourth transistor being connected to the collector of said first transistor, said collector of said fourth transistor being connected to said second voltage node, wherein the collectors of said first and second transistors are used as current input and output terminals of said current mirror circuit; and a correction circuit including a fifth transistor of the first polarity having a base, an emitter and a collector, said emitter of said fifth transistor being coupled to said first voltage node, a sixth transistor of the first polarity having a base, an emitter and a collector, said emitter of said sixth transistor being coupled to said first voltage node, said base of said sixth transistor being connected commonly to the base of said fifth transistor, said collector of said sixth transistor being connected to the base of said third transistor, a seventh transistor of the first polarity having a base, an emitter and a collector, said emitter of said seventh transistor being coupled to a base common connection node of said fifth and sixth transistors, said base of said seventh transistor being connected to the collector of said fifth transistor, an eighth transistor of the first polarity having a base, an emitter and a collector, said emitter of said eighth transistor being connected to the collector of said seventh transistor, said base of said eighth transistor being connected to the collector of said second transistor, said collector of said eighth transistor being connected to said second voltage node, and a ninth transistor of the second polarity having a base, an emitter and a collector, said base and said collector of said ninth transistor being connected to the base of said second transistor, said emitter of said ninth transistor being connected to the emitter of said eighth transistor.

2. The circuit according to claim 1, wherein said current mirror circuit further includes a tenth transistor of the first polarity having a base, an emitter and a collector, said emitter of said tenth transistor being coupled to said first voltage node, said base and collector of said tenth transistor being connected to a base common connection node of said first and transistors.

3. The circuit according to claim 1, wherein said current mirror circuit further includes a first resistor connected between said emitter of said first transistor and said first voltage node, and a second resistor connected between said emitter of said second transistor and said first voltage node, and said correction circuit further includes a third resistor connected between said emitter of said fifth transistor and said first voltage node, and a fourth resistor connected between said emitter of said sixth transistor and said first voltage node.

4. The circuit according to claim 2, wherein said current mirror circuit further includes a first resistor connected between said emitter of said first transistor and said first voltage node, a second resistor connected between said emitter of said second transistor and said first voltage node, and a third resistor connected between said emitter of said tenth transistor and said first voltage node, and said correction circuit further includes a fourth resistor connected between said emitter of said fifth transistor and said first voltage node, and a fourth resistor connected between said emitter of said sixth transistor and said first voltage node.

5. A current source circuit comprising:

a first voltage node to which a first voltage is supplied;

a second voltage node to which a second voltage lower than said first voltage is supplied;

a current mirror circuit including a first transistor of a first polarity having a base, an emitter and a collector, said emitter of said first transistor being coupled to said first voltage node, a second transistor of the first polarity having a base, an emitter and a collector, said emitter of said second transistor being coupled to said first voltage node, said base of said second transistor being connected commonly to the base of said first transistor, a third transistor of the first polarity having a base, an emitter, a collector, said emitter of said third transistor being connected to a base common connection node of said first and second transistors, said base of said third transistor being connected to the collector of said first transistor, said collector of said third transistor being connected to said second voltage node, and a fourth transistor of the first polarity having a base, an emitter and a collector, said emitter of said fourth transistor being coupled to said first voltage node, said base and collector of said fourth transistor being connected to the base common connection node of said first and second transistors, wherein the collectors of said first and second transistors are used as current input and output terminals of said current mirror circuit; and a correction circuit including a fifth transistor of the first polarity having a base, an emitter and a collector, said emitter of said fifth transistor being coupled to said first voltage node, a sixth transistor of the first polarity having a base, an emitter and a collector, said emitter of said sixth transistor being coupled to said first voltage node, said base of said sixth transistor being connected commonly to the base of said fifth transistor, said collector of said sixth transistor being connected to said second voltage node, a seventh transistor of the first polarity having a base, an emitter and a collector, said emitter of said seventh transistor being coupled to said first voltage note, said base of said seventh transistor being connected to a base common connection node of said fifth and sixth transistors, an eighth transistor of the first polarity having a base, an emitter and a collector, said emitter of said eighth transistor being connected to a base common connection node of said fifth, sixth and seventh transistors, said base of said eighth transistor being connected to the collector of said fifth transistor, said collector of said eighth transistor being connected to the collector of said seventh transistor, and a ninth transistor of a second polarity having a base, an emitter and a collector, said emitter of said ninth transistor being connected to the collector of said eighth transistor, said base of said ninth transistor being connected to the collector of said second transistor, said collector of said ninth transistor being connected to said second voltage node.

6. The circuit according to claim 5, wherein said current mirror circuit further includes a first resistor connected between said emitter of said first transistor and said first voltage node, and a second resistor connected between said emitter of said second transistor and said first voltage node, and a third resistor connected between said emitter of said fourth transistor and said first voltage node, and said correction circuit further includes a fourth resistor connected between said emitter of said fifth transistor and said first voltage node, a fifth resistor connected between said emitter of said sixth transistor and said first voltage node, and a sixth resistor connected between said emitter of said seventh transistor and said first voltage node.

7. The circuit according to claim 5, wherein further comprising:

a tenth transistor of the second polarity having a base, an emitter and a collector, said collector of said tenth transistor being connected to said first voltage node, said base of said tenth transistor being connected to said collector of said seventh transistor, and a current source circuit connected to said emitter of said tenth transistor.

8. A current source circuit comprising:

a first voltage node to which a first voltage is supplied;

a second voltage node to which a second voltage lower than said first voltage is supplied;

a current mirror circuit including a first transistor of a first polarity having a base, an emitter and a collector, said emitter of said first transistor being coupled to said first voltage node, a second transistor of the first polarity having a base, an emitter and a collector, said emitter of said second transistor being coupled to said first voltage node, said base of said second transistor being connected commonly to the base of said first transistor, a third transistor of a second polarity opposite to said first polarity having a base, an emitter and a collector, said collector of said third transistor being connected to a base common connection node of said first and second transistors, a fourth transistor of the first polarity having a base, an emitter and a collector, said emitter of said fourth transistor being connected to the emitter of said third transistor, said base of said fourth transistor being connected to said collector of said first transistor, said collector of said fourth transistor being connected to said second voltage node, and a fifth transistor of the first polarity having a base, an emitter and a collector, said emitter of said fifth transistor being coupled to said first voltage node, said base and collector of said fifth transistor being connected to the base common connection node of said first and second transistors, wherein the collectors of said first and second transistors are used as current input and output terminals of said current mirror circuit; and a correction circuit including a sixth transistor of the first polarity having a base, an emitter and a collector, said emitter of said sixth transistor being coupled to said first voltage node, a seventh transistor of the first polarity having a base, an emitter and a collector, said emitter of said seventh transistor being coupled to said first voltage node, said base of said seventh transistor being connected commonly to the base of said sixth transistor, said collector of said seventh transistor being connected to said second voltage node, an eighth transistor of the first polarity having a base, an emitter and a collector, said emitter of said eighth transistor being coupled to said first voltage node, said base of said eighth transistor being connected to a base common connection node of said sixth and seventh transistors, said collector of said eighth transistor being connected to the base of said third transistor, a ninth transistor of the first polarity having a base, an emitter and a collector, said emitter of said ninth transistor being connected to a base common connection node of said sixth, seventh and eighth transistors, said base of said ninth transistor being connected to the collector of said sixth transistor, a tenth transistor of the first polarity having a base, an emitter and a collector, said emitter of said tenth transistor being connected to the collector of said ninth transistor, said base of said tenth transistor being connected to the collector of said second transistor, said collector of said tenth transistor being connected to said second voltage node, and an eleventh transistor of the second polarity having a base, an emitter and a collector, said base and collector of said eleventh transistor being connected to the base of said third transistor, said emitter of said eleventh transistor being connected to the emitter of said tenth transistor.

9. The circuit according to claim 8, wherein further comprising:

a twelfth transistor of the second polarity having a base, an emitter and a collector, said collector of said twelfth transistor being connected to said first voltage node, said base of said twelfth transistor being connected to the emitter of said. eleventh transistor; and a current source circuit connected to said emitter of said twelfth transistor.

10. The circuit according to claim 8, wherein said current mirror circuit further includes a first resistor connected between said emitter of said first transistor and said first voltage node, a second resistor connected between said emitter of said second transistor and said first voltage node, and a third resistor connected between said emitter of said fifth transistor and said first voltage node, and said correction circuit further includes a fourth resistor connected between said emitter of said sixth transistor and said first voltage node, a fifth resistor connected between said emitter of said seventh transistor and said first voltage node, and a sixth resistor connected betweens said emitter of said eighth transistor and said first voltage node.

* * * * *